United States Patent [19]

Rosanio et al.

[11] Patent Number: 4,938,034

[45] Date of Patent: Jul. 3, 1990

[54] OPENED FRONT REFRIGERATED DISPLAY CASE

[75] Inventors: Ronald R. Rosanio; George E. Wallace, both of Levittown, Pa.

[73] Assignee: Hill Refrigeration Corporation, Trenton, N.J.

[21] Appl. No.: 346,858

[22] Filed: May 3, 1989

[51] Int. Cl.[5] ..... A47F 3/04

[52] U.S. Cl. ..... 62/256

[58] Field of Search ..... 62/255, 256

[56] References Cited

U.S. PATENT DOCUMENTS

| | | | |
|---|---|---|---|
| 2,463,614 | 3/1949 | Hardin . | |
| 2,495,554 | 1/1950 | Spangler . | |
| 2,594,066 | 4/1952 | Pabst . | |
| 2,630,684 | 3/1953 | Strang . | |
| 2,952,992 | 9/1960 | Voorhies . | |
| 2,993,349 | 7/1961 | Detwiler . | |
| 3,103,796 | 9/1963 | Dickson et al. . | |
| 3,186,185 | 6/1965 | Bently et al. . | |
| 3,229,475 | 1/1966 | Balk et al. | 62/256 |
| 3,287,929 | 11/1966 | Beckwith | 62/256 |
| 3,304,736 | 2/1967 | Brennan et al. | 62/176 |
| 3,304,740 | 2/1967 | Dickson et al. . | |
| 3,324,676 | 6/1967 | Gerweck | 62/256 |
| 3,365,908 | 1/1968 | MacMaster | 62/256 |
| 3,369,375 | 2/1968 | Gerweck et al. | 62/256 |
| 3,499,295 | 3/1970 | Brennan . | |
| 3,501,925 | 3/1970 | Brennan et al. . | |
| 3,517,526 | 6/1970 | MacMaster et al. . | |
| 3,528,258 | 9/1970 | Brennan . | |
| 3,531,945 | 10/1970 | Brennan . | |
| 3,675,440 | 7/1972 | Ibrahim | 62/255 |
| 3,751,653 | 8/1973 | Henry | 240/6 |
| 3,756,038 | 9/1973 | MacMaster et al. | 62/255 |
| 3,827,254 | 8/1974 | MacMaster et al. | 62/256 |
| 4,077,228 | 3/1978 | Schumacher et al. | 62/256 |
| 4,319,463 | 3/1982 | Ljung | 62/256 |
| 4,320,631 | 3/1982 | Vana | 62/256 |
| 4,592,209 | 6/1986 | Casanova et al. | 62/255 |
| 4,750,335 | 6/1988 | Wallace et al. | 62/248 |

*Primary Examiner*—Lloyd L. King

*Attorney, Agent, or Firm*—Sperry, Zoda & Kane

[57] ABSTRACT

An opened front refrigerated display case having multiple front refrigeration control air curtains and a supplemental refrigerated air curtain passing over the bin area thereof to aid in maintaining of the bin area of the display area of the case in an efficiently refrigerated condition and to minimize the accumulation of frost therein. The display case includes multiple inlets in the upper area above the opened front area and multiple outlets in the lower area below the opened front area to facilitate multiple curtains of controlled air passing thereover. The innermost lower inlet is adapted to also receive therein refrigerated air from a bin cooling air curtain which passes approximately horizontally over the bin area. Air is admitted into the curtain by a bin outlet positioned immediately adjacent to the main refrigeration flow duct path positioned immediately behind the bin area.

10 Claims, 2 Drawing Sheets

FIG. 2
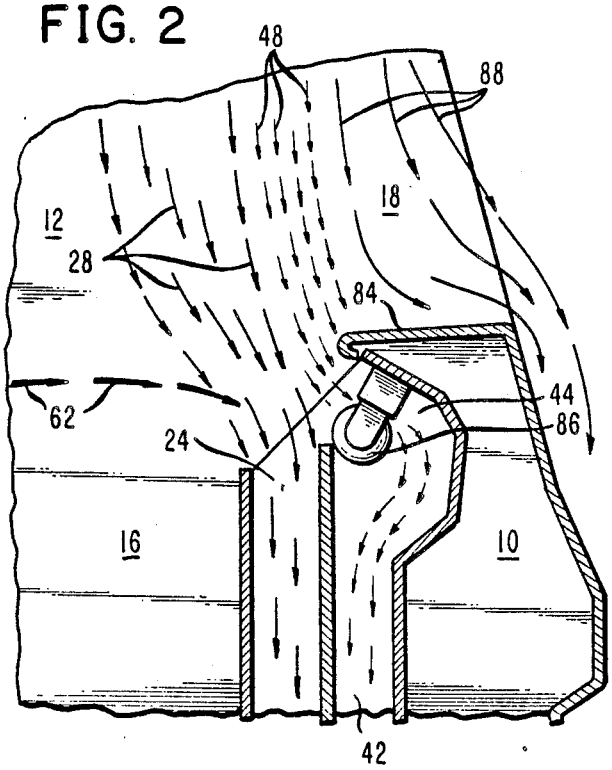
FIG. 5
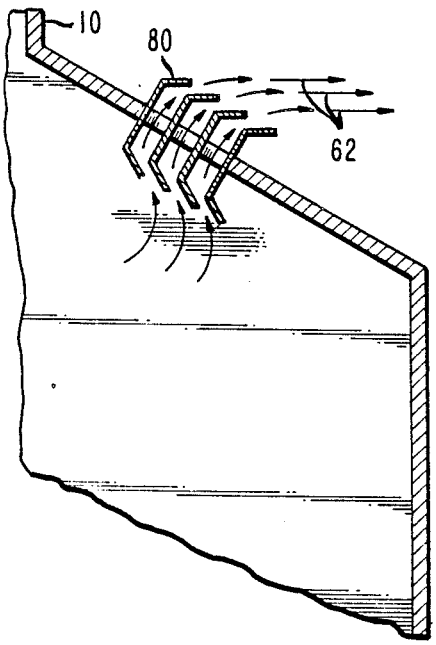
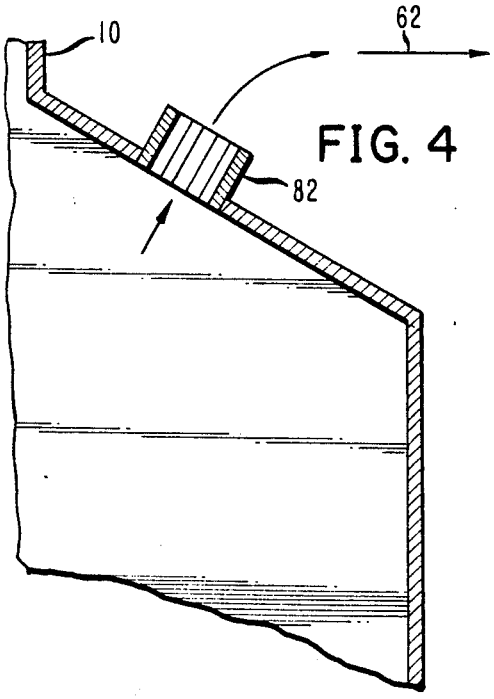
FIG. 4
FIG. 3
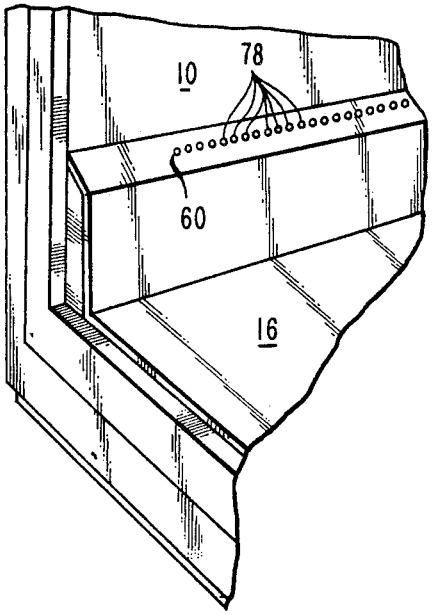

OPENED FRONT REFRIGERATED DISPLAY CASE

BACKGROUND OF THE INVENTION

1. Field Of The Invention

The present invention pertains to the general field of display cases commonly found within supermarkets and other areas where products are maintained on display for purchase. The present invention more particularly pertains to the refrigerated class of such display cases to facilitate display of products which must be cooled while displayed such as milk, ice cream and other frozen or refrigerated products. The present invention most particularly deals with the field of refrigerated display cases having multiple curtains of air designed to flow in a laminar fashion over an opened front area thereof such as to maintain the products therein under controlled temperature and moisture conditions and yet still allow ready access to the products located therein.

2. Description Of The Prior Art

Examples of prior art configurations utilizing refrigerated display cases with ducts for air flow and air curtain control are shown in U.S. Pat. No. 2,463,614 patented Mar. 8, 1949 to H. W. Harding for an Open-Top Display Refrigerator; U.S. Pat. No. 2,495,554 patented Jan. 24, 1950 to G. E. Spangler on an Open Top Refrigerated Display Case; U.S. Pat. No. 2,594,066 patented Apr. 22, 1952 to R. E. Pabst on a Two-Decker Dairy Self-Service Refrigerator; U.S. Pat. No. 2,630,684 patented Mar. 10, 1953 to M. H. Strang on a Refrigerated Multiple Shelf Display Case; U.S. Pat. No. 2,952,992 patented Sept. 20, 1960 to D. A. Voorhies on a Refrigerated Shelf; U.S. Pat. No. 2,993,349 patented July 25, 1961 to W. H. Detwiler on a Refrigerated Display Case; U.S. Pat. No. 3,103,796 patented Sept. 17, 1963 to E. V. Dickson et al on a Refrigeration System; U.S. Pat. No. 3,186,185 patented June 1, 1965 to G. K. Bently et al on a Refrigerated Display Unit; U.S. Pat. No. 3,229,475 patented Jan. 18, 1966 to J. Balk et al on a Refrigerated Display Case; U.S. Pat. No. 3,304,736 patented Feb. 21, 1967 to J. H. Brennan et al on a Refrigerated Display Case; U.S. Pat. No. 3,304,740 patented Feb. 21, 1967 to E. V. Dickson et al on an Open Front Display Case; U.S. Pat. No. 3,365,908 patented Jan. 30, 1968 to M. D. MacMaster on a Display Case; U.S. Pat. No. 3,369,375 patented Feb. 20, 1968 to L. J. Gerweck et al on a Refrigerated Display Case; U.S. Pat. No. 3,499,295 patented March 10, 1970 to J. H. Brennan on a Refrigeration System; U.S. Pat. No. 3,501,925 patented Mar. 24, 1970 to J. H. Brennan et al on Refrigerated Equipment; U.S. Pat. No. 3,517,526 patented June 30, 1970 to M. D. MacMaster et al on Refrigerated Equipment; U.S. Pat. No. 3,528,258 patented Sept. 15, 1970 to J. H. Brennan on a Refrigerated Display Case; U.S. Pat. No. 3,531,945 patented Oct. 6, 1970 to J. H. Brennan on Constant Temperature Refrigerated Equipment; U.S. Pat. No. 3,675,440 patented July 11, 1972 to F. Ibrahim on a Refrigerated Display Case; U.S. Pat. No. 3,751,653 patented Aug. 7, 1973 to J. Henry on a Refrigerated Display Case; U.S. Pat. No. 3,756,038 patented Sept. 4, 1973 to M. MacMaster et al on Refrigerated Display Equipment; U.S. Pat. No. 3,827,254 patented Aug. 6, 1974 to M. MacMaster et al on a Refrigerated Display Case; U.S. Pat. No. 4,077,228 patented March 7, 1978 to N. Schumacher et al on a Refrigerated Display Case; U.S. Pat. No. 4,319,463 patented Mar. 16, 1982 to H. Ljung on a Refrigerated Display Chest; U.S. Pat. No. 4,320,631 patented March 23, 1982 to J. Vana on an Air Defrost For Low-Bed Refrigerated Display Cases, Utilizing Sill-Mounted Auxiliary Fan; U.S. Pat. No. 4,592,209 patented June 3, 1986 to G. Casanova on a Display Counter For Food Products, Refrigerated By Forced Ventilation and U.S. Pat. No. 4,750,335 patented June 14, 1988 to G. Wallace et al on an Anti-Condensation Means For Glass Front Display Cases.

SUMMARY OF THE INVENTION

The present invention provides an opened front refrigerated display case having multiple front refrigeration control curtain means and supplemental bin cooler means. The display case includes a housing having a display compartment area with a display bin area defined in the lower portion thereof. An opened front area is defined to facilitate placement or removal of articles positioned within the display area and within the display bin area therebelow.

A primary refrigeration means is included having a primary refrigeration duct extending throughout the housing. The primary refrigeration duct defines a primary inlet below the opened front area and a primary outlet above the opened front area. The refrigeration duct is adapted to expel refrigerated air therefrom to pass over the front area and into the primary inlet to thereby form a primary refrigeration curtain extending thereover. A primary refrigeration coil means is positioned within the primary refrigeration duct to receive air flowing therethrough to facilitate refrigeration thereof. A primary fan is positioned within the primary refrigeration duct to urge air flow therethrough.

A secondary cooling means is included having a secondary duct extending through the housing. The secondary duct defines a secondary inlet below the opened front area adjacent the primary inlet. The secondary duct further includes a secondary outlet above the opened front area adjacent the primary outlet. The secondary refrigeration duct is adapted to expel air from the secondary outlet to pass over the opened front area and into the secondary inlet to form a secondary refrigeration air curtain extending thereover. A secondary fan means is positioned within the secondary duct to facilitate air flow therethrough.

An ambient air flow control means is included comprising an ambient duct extending through the housing means. The ambient duct defines a ambient inlet in the housing and an ambient outlet within the housing above the opened front area. The ambient outlet is adapted to expel air therefrom over the opened front area to form an ambient air curtain extending thereover. An ambient fan is included positioned within the ambient duct to facilitate the flow of ambient air therethrough.

A bin area supplemental refrigeration means is included which defines a display bin refrigeration outlet positioned within the primary refrigeration duct between the primary refrigeration coil and the primary outlet. The display bin refrigeration outlet is preferably adjacent the display bin area to allow the flow of refrigerated air thereover to facilitate refrigeration thereof and to minimize frosting thereof. The display bin refrigeration outlet is adapted to expel refrigerated air immediately from the primary refrigeration duct across the display bin area into the primary inlet to form the bin refrigeration air curtain extending thereover.

Preferably a check valve means is included extending over the display bin refrigeration outlet means to allow air flow outwardly therethrough from the primary refrigeration duct into the bin area and to prevent air flow in the opposite direction. This check valve means may take the form of a flexible flap member and is designed to allow outward air flow but to prevent inward air flow through the display bin refrigeration outlet in the opposite direction when air flow through the primary refrigeration duct is conducted in the opposite direction such as during reverse air defrosting thereof.

A bottom shelf member may be positioned within the display compartment area immediately above the display bin area for retaining the articles to be displayed thereon and for presenting a guiding surface facing downwardly therefrom to facilitate guiding of the display bin refrigeration air curtain toward the primary inlet.

Preferably the primary fan will urge the refrigerated air to exit the primary outlet at a linear velocity greater than the linear velocity that the secondary fan urges the air to be expelled through the secondary outlet. In this manner the primary air curtain will be moving at a greater velocity than the secondary air curtain. In a similar manner it is preferable that the secondary fan means will urge air to exit the secondary outlet at a linear velocity greater than the linear velocity than the ambient fan urges ambient air to be expelled from the ambient outlet in order to provide a linear air speed in the secondary air curtain greater than the linear air speed in the ambient air curtain. Preferably the approximate linear speed of the primary air curtain will be 600/650 feet per minute and the linear speed of the secondary air curtain will be between 375/425 feet per minute. Finally it is preferable that the ambient air curtain be moving at a linear speed of approximately 200/250 feet per minute.

It is also preferable that the primary refrigeration curtain be maintained at an air temperature lower than the secondary air curtain and that the secondary air curtain be maintained at a temperature lower than the temperature of the ambient air curtain. This is achieved due to some mixing of the primary and secondary curtains as they move downwardly toward their respective inlets at the lower portion of the opened front surface. Such mixing is not desirable and is necessarily minimized. However some mixing will always occur which will thereby cool the air flowing through the secondary air flow path to make that curtain cooler than the ambient air curtain immediately positioned outwardly therefrom. The display bin air curtain will preferably extend horizontally from the display bin outlet means to the primary inlet means. Guiding of movement of the display bin air curtain can be controlled by louver means or air flow control means positioned at the outlets to guide movement of the air passing therethrough in an approximately horizontally oriented direction thereof. These guide means can be honeycomb or of conventional louver designs.

To facilitate refrigeration of air passing through the primary refrigeration duct the primary refrigeration coil can take the form of a first coil positioned within the primary refrigeration duct between the primary inlet and the primary fan means. This refrigeration means will cool the air but will also primarily remove most of the moisture therefrom. The air will then pass the primary fan and will then enter a secondary coil positioned immediately downstream from the primary fan means within the primary refrigeration duct. This secondary coil will facilitate cooling of the air passing therefrom. Preferably the second coil means will be positioned immediately behind the bin area and the bin curtain outlet will be positioned immediately thereadjacent such as to supply cooled air immediately after passing through the secondary coil directly t the display bin air curtain.

It is an object of the present invention to provide an opened front refrigerated display case having multiple front refrigeration control curtains and supplemental bin cooling means wherein energy and other operating costs are minimized.

It is an object of the present invention to provide an opened front refrigerated display case having multiple front refrigeration control curtains and supplemental bin cooling means wherein initial cost and capital outlay is approximately equal to currently available equipment.

It is an object of the present invention to provide an opened front refrigerated display case having multiple front refrigeration control curtains and supplemental bin cooling means wherein defrost is possible in many different manners including utilizing hot gas defrost, ambient defrost or electric defrost.

It is an object of the present invention to provide an opened front refrigerated display case having multiple front refrigeration control curtains and supplemental bin cooling means wherein accumulation of frost within the display area is minimized.

It is an object of the present invention to provide an opened front refrigerated display case having multiple front refrigeration control curtains and supplemental bin cooling means wherein accumulation of frost particularly within the display bin area is minimized.

It is an object of the present invention to provide an opened front refrigerated display case having multiple front refrigeration control curtains and supplemental bin cooling means wherein maintenance costs are minimized.

It is an object of the present invention to provide an opened front refrigerated display case having multiple front refrigeration control curtains and supplemental bin cooling means wherein full refrigeration of articles designed to be maintained at freezing temperatures is made possible with an opened front refrigerated display case design.

It is an object of the present invention to provide an opened front refrigerated display case having multiple front refrigeration control curtains and supplemental bin cooling means wherein defrost times or cycles are not inhibited by supplemental bin cooling means.

It is an object of the present invention to provide an opened front refrigerated display case having multiple front refrigeration control curtains and supplemental bin cooling means wherein usage with multiple longitudinal sections of case are made possible.

It is an object of the present invention to provide an opened front refrigerated display case having multiple front refrigeration control curtains and supplemental bin cooling means wherein mixing between four air curtains extending over the displayed product is minimized.

It is an object of the present invention to provide an opened front refrigerated display case having multiple front refrigeration control curtains and supplemental bin cooling means wherein the primary air inlet is used for receiving both the primary refrigeration air curtain and the supplemental bin area refrigeration curtain.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 2 is a side cross sectional view showing the air curtain inlet area of FIG. 1 enlarged;

FIG. 3 is a perspective illustration of an embodiment of the display bin refrigeration outlet means;

FIG. 4 is a side cross sectional view of an embodiment of the display bin refrigeration outlet means of the present invention; and FIG. 5 is an alternative side cross-sectional view of an embodiment of the display bin refrigeration outlet means of the present invention.

DETAILED DESCRIPTION OF THE PREFERRED EMBODIMENT

Figure 1:
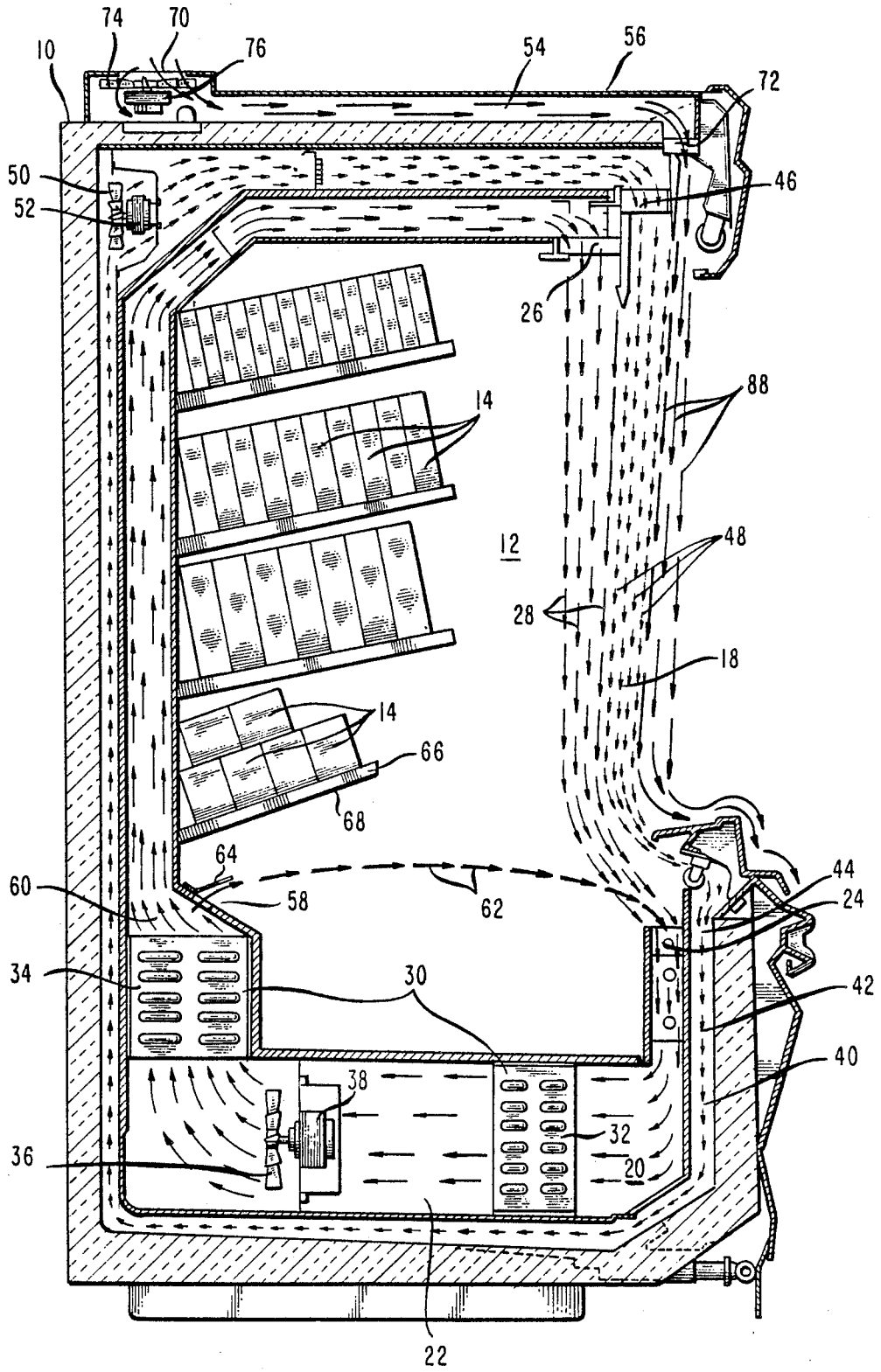
FIG. 1 is a side cross sectional view of an embodiment of an opened front refrigerated display case illustrating the present invention.

The present invention provides a housing means 10 which defines a display compartment area 12 therein. Display compartment area 12 is adapted to retain a plurality of articles 14 therein such that access thereto is made possible through an opened front area 18 defined by the housing means 10. Below the display compartment area 12 a display bin area 16 is adapted to hold articles 14 at the lowest possible temperature.

To facilitate cooling of the display compartment area 12 the housing means 10 defines a primary refrigeration means 20. The primary refrigeration means 20 preferably includes a primary refrigeration duct means 22 which preferably extends circumferentially about the periphery of the cross section of the longitudinally extending display housing 10. The primary refrigeration duct 22 preferably extends from a primary inlet 24 defined at the lower edge of the opened front area 18 peripherally about the case to a primary outlet 26 positioned at the upper edge of the opened front area 18. Air will pass through the primary refrigeration duct for cooling thereof and will exit the primary outlet 26 and pass downwardly to the primary inlet 24 thereby completing the air flow circuit. The air passing from primary outlet 26 to primary inlet 24 will preferably be laminar downward flow thereby forming a primary refrigeration air curtain 28.

Cooling of air passing through the primary refrigeration duct 22 will be made possible by a primary refrigeration coil means 30. Coil means 30 may preferably be positioned adjacent the primary fan means 36 and the primary motor means 38 operable to control powering of the primary fan means 36. Primary refrigeration coil 30 may also include a first coil means 32 positioned upstream from the primary fan 36 and a second coil means 34 positioned downstream from the primary fan means 36. In this manner the first coil 32 will primarily be designed to remove most of the moisture from the air passing through the primary refrigeration duct and the second coil means 34 will be designed to perform most of the refrigeration of the air passing therethrough.

A secondary cooling means 40 will preferably include a secondary duct means 42 extending peripherally about the display case preferably immediately outwardly from the primary refrigeration duct 22. Secondary duct 42 will include a secondary inlet 44 adjacent the primary inlet 24 and will include a secondary outlet 46 preferably adjacent the primary outlet 26. In the preferred orientation the passage of air out through the secondary outlet 46 and in through the secondary inlet 44 will form a secondary refrigeration air curtain means 48 positioned immediately adjacent the primary refrigeration air curtain 28 in the direction opposite from the display compartment area 12.

A secondary fan means 50 will be positioned within the secondary duct 42 and will be powered by a secondary motor means 52. Secondary fan 50 is designed to cause air to pass through the secondary duct 42 in through the secondary inlet 44 and out through the secondary outlet 46. The secondary fan 50 will be adapted to maximize the laminar flow characteristics of the secondary refrigeration air curtain. The secondary cooling means 40 does not include any self-contained cooling means. However there it will be maintained at a temperature lower than the ambient conditions due to some mixing between the primary refrigeration air curtain 28 and the secondary refrigeration air curtain 48 as they pass immediately adjacent one another downwardly across the opened front area 18 of housing 10. Mixing between these curtains is minimized to the greatest extent possible. However some mixing will always occur and it is this mixing which reduces the temperature of the secondary air curtain somewhat below that of the ambient environment. Since the secondary cooling means 40 does not include any self-contained refrigeration or cooling means the cooling thereof is achieved primarily by this undesirable but always present mixing between the primary and secondary curtains.

To further isolate the environment of the display compartment area 12 and the display bin area 16 from the surrounding environment an ambient air flow control means 54 is included defining an ambient duct means 56 extending from ambient inlet 70 to a ambient outlet 72. Ambient fan means 74 powered by an ambient motor means 76 is positioned therein to facilitate air flow through ambient duct 56. Preferably the ambient outlet 72 is positioned immediately adjacent the secondary outlet 46 in a direction opposite from the display compartment area 12. The ambient air curtain 88 will then pas downwardly therefrom immediately adjacent and outwardly from the secondary refrigeration air curtain 48 for passing downwardly in the direction across the open front area 18. When the ambient curtain reaches the lower end of the open front area 18 it will contact the front deflector member 84 for deflecting thereof outwardly. Since the supply of ambient air is virtually unlimited there is no need for providing a full circuit for ambient air flow. For this reason it is convenient and conventional to have the ambient inlet 70 defined in the upper area of the case to minimize capital cost of this equipment.

A primary novel characteristic of the present invention is in the usage of a bin area supplemental refrigeration means 58. Supplemental refrigeration means 58 is adapted to pass air through a display bin refrigeration outlet means 60 defined preferably in the rear wall of the display compartment area 12 immediately above the display bin area 16. Preferably the display bin refrigeration outlet means will be positioned immediately adjacent the downstream end of a second coil means 34 of the primary refrigeration coil means 30 within the primary refrigeration duct 22. In this manner after being refrigerated the air will directly pass through the display bin outlet to form a bin refrigeration air curtain 62 which will be guided and directed for horizontal movement across the display bin area 16. The display bin refrigeration air curtain 62 is adapted to be mixed with the primary refrigeration curtain 28 to enter into the primary inlet 24 for cycling therethrough. In this manner the primary refrigeration duct 22 will supply air to both the primary refrigeration air curtain 28 and the bin refrigeration air curtain 62. These two curtains will use the same inlet but will use different outlets to thereby achieve cooling of different areas. Preferably the bin refrigeration air curtain 62 will extend horizontally. If a portion of the primary refrigeration coil 30 is positioned within the primary refrigeration duct 22 immediately behind the display bin area 16 then the housing 10 can define the display bin refrigeration outlets 60 immediately above the display bin area 16. A configuration utilizing multiple apertures 78 is shown best in FIG. 3. As further shown in FIG. 1 a check valve means 64 such as a flexible flap member can be positioned extending over the display bin refrigeration outlets to allow flow outwardly from the primary refrigeration duct but to prevent a flow inwardly therethrough. In this manner if reverse flow through the primary refrigeration duct is necessary such as when utilizing air defrost made possible by reverse operation of primary motor means 38 then refrigerated air will not be drawn into the primary refrigeration means which would extend such defrost time.

Movement of the bin refrigeration air curtain 62 to the primary inlet 24 can be facilitated by positioning of a bottom shelf means 66 with a bin area guide means 68 along the lower surface thereof. Although not required the usage of a bottom shelf immediately above the bin area would facilitate the horizontal orientation of the bin area supplemental refrigeration means 58. Further control of movement of the bin refrigeration curtain 62 can be made possible by the usage of louver means 80 or honeycomb air guide means 82 to direct air exiting from the display bin refrigeration outlets 60.

A bin lighting means 86 is preferably positioned at the lower portion of the opened front area 18 immediately adjacent primary inlet 24 and secondary inlet 44. The bulb in the preferred configuration shown best in FIG. 2 is positioned between the primary inlet 24 and the secondary inlet 44 to thereby be positioned between the primary refrigeration air curtain 28 and the secondary refrigeration air curtain 48.

In operation the present invention has been found to provide extensive energy savings resulting from the inclusion of the supplemental display bin refrigeration air curtain extending horizontally immediately above the display bin 16. Shown below are test results showing extensive savings of between 15 and 20 per cent in operating costs. Most of the savings are achieved due to the elimination of energy losses and refrigeration losses which occur with a display case not having the supplemental display bin cooling curtain 62. The total savings in kilowatt hours per foot per day are shown reduced from 10.74 to 8.90 by the inclusion of the bin cooler. It should be noted that the bin cooler does not increase the refrigeration load upon the primary refrigeration and cooling means but only admits a portion of that cooling at an earlier point in the flow path through the primary refrigeration duct 22. This additional refrigeration aspect has proved to provide extensive energy savings of the entire unit and to increase the efficiency of cooling and to minimize condensation within the display bin area 16.

| Reference Data | Without Bin Cooler | With Bin Cooler |
|---|---|---|
| Case Length (Ft.) | 12.00 | 12.00 |
| BTUH Requirement | 20328 | 19200 |
| Suction Temperature | −25 | −15 |
| BTUH/WATT @ Suction Temp. | 4.9 | 5.6 |
| Condensing Unit Power (Watts) | 4149 | 3429 |
| Number of Defrosts/Day | 2 | 2 |
| Number Minutes/Defrost (safe) | 34 | 34 |
| **Power Requirement** | **WATTS** | **WATTS** |
| Standard Case Lights 115V | 336 | 336 |
| Fan Motors & A.C. Htrs 115V | 907 | 676 |
| Condensing Unit 208V | 4149 | 3429 |
| Defrost Heaters 208V | 7200 | 7200 |
| **Power Consumptions** | **KWH/FT/DAY** | **KWH/FT/DAY** |
| Standard Case Lights 115V | 0.34 | 0.34 |
| Fan Motors & A.C. Htrs 115V | 1.81 | 1.35 |
| Condensing Unit 208V | 7.91 | 6.53 |
| Defrost Heaters 208V | 0.68 | 0.68 |
| Total KWH/FT/DAY: | 10.74 | 8.90 |
| **Annual Operating Cost ($/YR)** | | |
| @ $0.03/kwh | 1410.62 | 1169.64 |
| @ $0.06/kwh | 2821.25 | 2339.27 |
| @ $0.10/kwh | 4702.08 | 3898.78 |

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An opened front refrigerated display case having multiple front refrigeration control curtain means and supplemental bin cooler means comprising:

(a) a housing means comprising:

(1) a display compartment area adapted for receiving and retaining articles therein;

(2) a display bin area in the lowermost section of said display compartment means for receiving and retaining articles therein;

(3) an open front area to facilitate placement and removal of articles positioned within said display therebelow;

(b) a primary refrigeration means comprising:

(1) a primary refrigeration duct means extending through said housing means, said primary refrigeration duct means defining a primary inlet below said open front area and a primary outlet above said open front area, said primary refrigeration duct means being adapted to expel refrigerated air from said primary outlet to pass over said open front area and into said primary inlet to form a primary refrigeration curtain thereover;

(2) a primary refrigeration coil means positioned within said primary refrigeration duct means to receive air flowing therethrough for refrigeration thereof;

(3) a primary fan means positioned within said primary refrigeration duct means to facilitate air flow therethrough;

(c) a secondary cooling means comprising:

(1) a secondary duct means extending through said housing means, said secondary duct means defining a secondary inlet below said open front area adjacent said primary inlet, said secondary duct means further including a secondary outlet above said open front area adjacent said primary outlet, said secondary refrigeration duct means being adapted to expel air from said secondary outlet to pass over said open front area and into said secondary inlet to form a secondary refrigeration air curtain thereover;

(2) a secondary fan means positioned within said secondary duct means to facilitate air flow therethrough;

(d) an ambient air flow control means comprising:

(1) an ambient duct means extending through said housing means, said ambient duct means defining an ambient inlet in said housing and an ambient outlet within said housing above said open front area, said ambient outlet being adapted to expel air therefrom over said open front area to form an ambient air curtain extending thereover;

(2) an ambient fan means positioned within said ambient duct means to facilitate ambient air flow therethrough; and (e) a bin area supplemental refrigeration means defining a display bin refrigeration outlet means positioned within said primary refrigeration duct means between said primary refrigeration coil and said primary outlet adjacent said display bin area to flow refrigerated air over said display bin area to facilitate refrigeration thereof, said display bin refrigeration outlet means adapted to expel refrigerated air therefrom across said display bin area into said primary inlet to form a bin refrigeration air curtain extending thereover; and (f) a one-way check valve means extending over said display bin refrigeration outlet means to selectively facilitate air flow outwardly therethrough from said primary refrigeration duct means and to selectively prevent air flow inwardly therethrough into said primary refrigeration duct means.

2. An opened front refrigerated display case having multiple front refrigeration control curtain means and supplemental bin cooler means as defined in claim 1 wherein said check valve means comprises a flexible flap means.

3. An opened front refrigerated display case having multiple front refrigeration control curtain means and supplemental bin cooler means as defined in claim 1 wherein said check valve means is movable between a closed position preventing air flow through said display bin refrigeration outlet and an opened position allowing air flow through said display bin refrigeration outlet.

4. An opened front refrigerated display case having multiple front refrigeration control curtain means and supplemental bin cooler means as defined in claim 1 further comprising a bottom shelf means positioned within said display compartment area immediately above said display bin area for retaining articles to be displayed thereon and for guiding movement of the bin refrigeration air curtain toward said primary inlet.

5. An opened front refrigerated display case having multiple front refrigeration control curtain means and supplemental bin cooler means as defined in claim 1 wherein said bin refrigeration air curtain is adapted to extend generally horizontally over the top area of said display bin area to facilitate refrigeration thereof.

6. An opened front refrigerated display case having multiple front refrigeration control curtain means and supplemental bin cooler means as defined in claim 1 wherein said display bin refrigeration outlet means comprises a plurality of adjacently positioned apertures defined within said housing means.

7. An opened front refrigerated display case having multiple front refrigeration control curtain means and supplemental bin cooler means as defined in claim 1 further including bin area air guide means to facilitate linear flow of refrigerated air within said bin refrigeration air curtain.

8. An opened front refrigerated display case having multiple front refrigeration control curtain means and supplemental bin cooler means as defined in claim 1 wherein said bin refrigerated air curtain is colder than said primary refrigeration air curtain, said secondary refrigeration curtain and said ambient air curtain.

9. An opened front refrigerated display case having multiple front refrigeration control curtain means and supplemental bin cooler means as defined in claim 1 wherein said bin refrigeration air curtain is adapted to mix with said primary refrigeration curtain adjacent to said primary inlet to facilitate movement thereinto of air from both curtains.

10. An opened front refrigerated display case having multiple front refrigeration control curtain means and supplemental bin cooler means comprising:

(a) a housing means comprising:

(1) a display compartment area adapted for receiving and retaining articles therein;

(2) a display bin area in the lowermost section of said display compartment means for receiving and retaining articles therein;

(3) an open front area to facilitate placement and removal of articles positioned within said display compartment area and said display bin area therebelow;

(b) a primary refrigeration means comprising:

(1) a primary refrigeration duct means extending through said housing means, said primary refrigeration duct means defining a primary inlet below said open front area and a primary outlet above said open front area, said primary refrigeration duct means being adapted to expel refrigerated air from said primary outlet to pass over said open front area and into said primary inlet to form a primary refrigeration curtain thereover;

(2) a primary refrigeration coil means positioned within said primary refrigeration duct means to receive air flowing therethrough for refrigeration thereof;

(a) a first coil means positioned within said primary refrigeration duct means between said primary inlet and said primary fan means to facilitate cooling of air passing through said primary refrigeration duct means;

(b) a second coil means positioned between said primary fan means and said display bin refrigeration outlet means to facilitate further cooling of air passing through said primary refrigeration duct means;

(3) a primary fan means positioned within said primary refrigeration duct means to facilitate air flow therethrough, said primary fan means urging refrigerated air outwardly through said primary outlet at approximately 600 to 650 feet per minute;

(4) a primary motor means operatively connected to said primary fan means for driving thereof, said primary motor means being reversible to facilitate defrost of said display compartment area and said display bin area;

(c) a secondary cooling means comprising:

(1) a secondary duct means extending through said housing means, said secondary duct means defining a secondary inlet below said open front area adjacent said primary inlet, said secondary duct means further including a secondary outlet above said open front area adjacent said primary outlet, said secondary refrigeration duct means being adapted to expel air from said secondary outlet to pass over said open front area and into said secondary inlet to form a secondary refrigeration air curtain being warmer than said primary refrigeration air curtain;

(2) a secondary fan means positioned within said secondary duct means to facilitate air flow therethrough, said secondary fan means urging refrigerated air outwardly through said secondary outlet at approximately 375 to 425 feet per minute;

(3) a secondary motor means operatively connected to said secondary fan means for driving thereof;

(d) an ambient air flow control means comprising:

(1) an ambient duct means extending through said housing means, said ambient duct means defining an ambient inlet in the top of said housing and an ambient outlet within said housing above said open front area, said ambient outlet being adapted to expel air therefrom over said open front area to form an ambient air curtain extending thereover, said ambient air curtain being warmer than said secondary air curtain;

(2) an ambient fan means positioned within said ambient duct means to facilitate ambient air flow therethrough, said ambient fan means urging refrigerated air outwardly through said ambient outlet at approximately 200 to 250 feet per minute;

(3) an ambient drive means operatively secured with respect to said ambient fan means for driving thereof;

(e) a bin area supplemental refrigeration means defining a display bin refrigeration outlet means positioned within said primary refrigeration duct means between said primary refrigeration coil and said primary outlet immediately adjacent said display bin area to flow refrigerated air over said display bin area to facilitate refrigeration thereof, said display bin refrigeration outlet means comprising a plurality of adjacently positioned apertures defined within said housing means, said display bin refrigeration outlet means adapted to expel refrigerated air therefrom across said display bin area into said primary inlet to form a bin refrigeration air curtain extending generally horizontally thereover; and (f) a pneumatic check valve means extending over said display bin refrigeration outlet means to allow air flow outwardly therethrough from said primary refrigeration duct means and to prevent air flow inwardly therethrough into said primary refrigeration duct means, said pneumatic check valve means being movable between a closed position preventing air flow through said display bin refrigeration outlet and an opened position allowing air flow through said display bin refrigeration outlet.

* * * * *